US008918045B2

(12) United States Patent
Sakurai et al.

(10) Patent No.: US 8,918,045 B2
(45) Date of Patent: Dec. 23, 2014

(54) IMAGE GLOSSING APPARATUS, IMAGE GLOSSING METHOD, AND RECORDING MEDIUM STORING IMAGE GLOSSING PROGRAM

(75) Inventors: Yoichi Sakurai, Kanagawa (JP); Shinya Kobayashi, Kanagawa (JP); Tadashi Kasai, Kanagawa (JP); Masakazu Terao, Kanagawa (JP); Yoshihiro Sonohara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 189 days.

(21) Appl. No.: 13/534,430

(22) Filed: Jun. 27, 2012

(65) Prior Publication Data

US 2013/0011173 A1 Jan. 10, 2013

(30) Foreign Application Priority Data

Jul. 4, 2011 (JP) ..... 2011-148204
Jun. 1, 2012 (JP) ..... 2012-125982

(51) Int. Cl.
*G03G 15/20* (2006.01)
*G03G 15/00* (2006.01)

(52) U.S. Cl.
CPC .. *G03G 15/6585* (2013.01); *G03G 2215/00805* (2013.01); *G03G 2215/0129* (2013.01); *G03G 2215/00721* (2013.01)
USPC ..... 399/341; 399/322; 399/361; 399/390

(58) Field of Classification Search
USPC ..... 399/69, 322, 341, 361, 390, 407
See application file for complete search history.

(56) References Cited

U.S. PATENT DOCUMENTS

| | | | | |
|---|---|---|---|---|
| 7,333,122 | B2 * | 2/2008 | Park et al. | 347/171 |
| 7,581,799 | B2 * | 9/2009 | Im et al. | 347/14 |
| 2002/0136576 | A1 * | 9/2002 | Ueda | 399/396 |
| 2007/0059066 | A1 * | 3/2007 | Fukatsu et al. | 399/341 |
| 2011/0103855 | A1 * | 5/2011 | Morikawa | 399/341 |
| 2011/0206429 | A1 | 8/2011 | Terao et al. | |
| 2011/0223527 | A1 | 9/2011 | Iio et al. | |
| 2012/0082829 | A1 | 4/2012 | Iio et al. | |
| 2012/0105915 | A1 | 5/2012 | Kobayashi et al. | |
| 2012/0107004 | A1 * | 5/2012 | Sonohara et al. | 399/69 |
| 2012/0134696 | A1 | 5/2012 | Kobayashi et al. | |
| 2012/0155939 | A1 * | 6/2012 | Fukatsu et al. | 399/341 |

FOREIGN PATENT DOCUMENTS

| | | |
|---|---|---|
| JP | 7-319318 | 12/1995 |
| JP | 9-200551 | 7/1997 |
| JP | 2003-114559 | 4/2003 |
| JP | 2010-181636 | 8/2010 |

* cited by examiner

*Primary Examiner* — Francis Gray
(74) *Attorney, Agent, or Firm* — Oblon, Spivak, McClelland, Maier & Neustadt, L.L.P.

(57) ABSTRACT

An image glossing apparatus including a recording sheet feeder feeding a recording sheet bearing a toner image; a glossing device including a heater heating a glossing portion of the toner image to gloss the portion; a glossiness information obtaining device obtaining position information on the position of the glossing portion; and a position detector including a tip detector detecting tip of the fed recording sheet, and a distance measuring device measuring the moving distance of the recording sheet after the tip of the recording sheet is detected. The position detector detects the position of a portion of the recording sheet facing the heater based on the information on the tip of the recording sheet and the information on the moving distance of the recording sheet. When the portion of the recording sheet facing the heater is the glossing portion, the heater heats the portion to gloss the glossing portion.

6 Claims, 11 Drawing Sheets

IMAGE GLOSSING APPARATUS, IMAGE GLOSSING METHOD, AND RECORDING MEDIUM STORING IMAGE GLOSSING PROGRAM

CROSS-REFERENCE TO RELATED APPLICATIONS

This patent application is based on and claims priority pursuant to 35 U.S.C. §119 to Japanese Patent Applications Nos. 2011-148204 and 2012-125982, filed on Jul. 4, 2011 and Jun. 1, 2012, respectively, in the Japan Patent Office, the entire disclosure of which is hereby incorporated herein by reference.

FIELD OF THE INVENTION

The present invention relates to an image glossing apparatus. In addition, the present invention also relates to an image glossing method, and a recording medium storing image glossing program.

BACKGROUND OF THE INVENTION

In general, when a photographic image is printed, the printed image is required to have high glossiness so that the resultant color image has good clearness and high class looking. In attempting to produce such glossy images, techniques of controlling the glossiness of images using a transparent toner have been proposed and used. However, the glossiness (glossiness GS measured at an angle of 60°) of images prepared by using such a transparent toner is 70% at most. In attempting to produce images having glossiness higher than 70%, a print controlling device which heats a recording sheet having a toner image thereon while applying pressure to the recording sheet set on a belt to smooth the surface of the toner image is proposed.

However, a business document, which typically consists of character images, is required to have low glossiness so that the character images are legible. When a photographic image and a character image are formed on one recording sheet using such a print controlling device as mentioned above, the glossing device of the print controlling device has to perform the glossing operation in such a manner that the photographic image is glossed, and the character image is not glossed.

The belt of the print controlling device used for glossing images has so smooth surface that a recording sheet easily slips on the belt, and therefore it is difficult to determine the position of the photographic image on the recording sheet (i.e., the position of a portion of the recording sheet to be subjected to a glossing treatment).

For these reasons, the inventors recognized that there is a need for an image glossing apparatus which can precisely determine the position of a portion of the recording sheet to be subjected to a glossing treatment to perform a glossing treatment only on the image to be glossed.

BRIEF SUMMARY OF THE INVENTION

As an aspect of the present invention, an image glossing apparatus is provided which glosses at least part of a fixed toner image on a surface of a recording sheet and which includes a recording sheet feeder to feed the recording sheet bearing the fixed toner image in a predetermined direction; a glossing device including a heater to heat a glossing portion of the fixed toner image to gloss the glossing portion of the fixed toner image; a glossiness information obtaining device to obtain glossiness information including position information on the position of the glossing portion on the recording sheet; and a position detector to detect the position of a portion of the recording sheet facing the heater.

The position detector includes a tip detector to detect the tip of the recording sheet fed by the recording sheet feeder, and a distance measuring device to measure the moving distance of the recording sheet fed by the recording sheet feeder after the tip detector detects the tip of the recording sheet. The position detector detects the position of the portion of the recording sheet facing the heater based on the information on the tip of the recording sheet obtained by the tip detector and the information on the moving distance of the recording sheet obtained by the distance measuring device. When the portion of the recording sheet facing the heater is the glossing portion, the heater heats the portion to gloss the portion of the toner image.

As another aspect of the present invention, an image glossing method for glossing at least part of a fixed toner image on a surface of a recording sheet using a heater is provided. The image glossing method includes feeding the recording sheet bearing the fixed toner image in a predetermined direction; obtaining glossiness information including position information on the position of a glossing portion of the recording sheet to be glossed; detecting the tip of the fed recording sheet; measuring the moving distance of the fed recording sheet after detecting the tip of the recording sheet; detecting the position of the portion of the recording sheet facing the heater based on the information on the tip of the recording sheet and the information on the moving distance of the recording sheet; and heating the portion of the recording sheet facing the heater to gloss the portion when the portion is the glossing portion.

As yet another aspect of the present invention, a non-transitory computer readable medium is provided which stores computer instructions, which, when executed by a computer, cause the computer to perform the image glossing method mentioned above.

The aforementioned and other aspects, features and advantages will become apparent upon consideration of the following description of the preferred embodiments taken in conjunction with the accompanying drawings.

DETAILED DESCRIPTION OF THE INVENTION

An example of the image glossing apparatus of the present invention will be described by reference to FIGS. 1-18.

Figure 1:
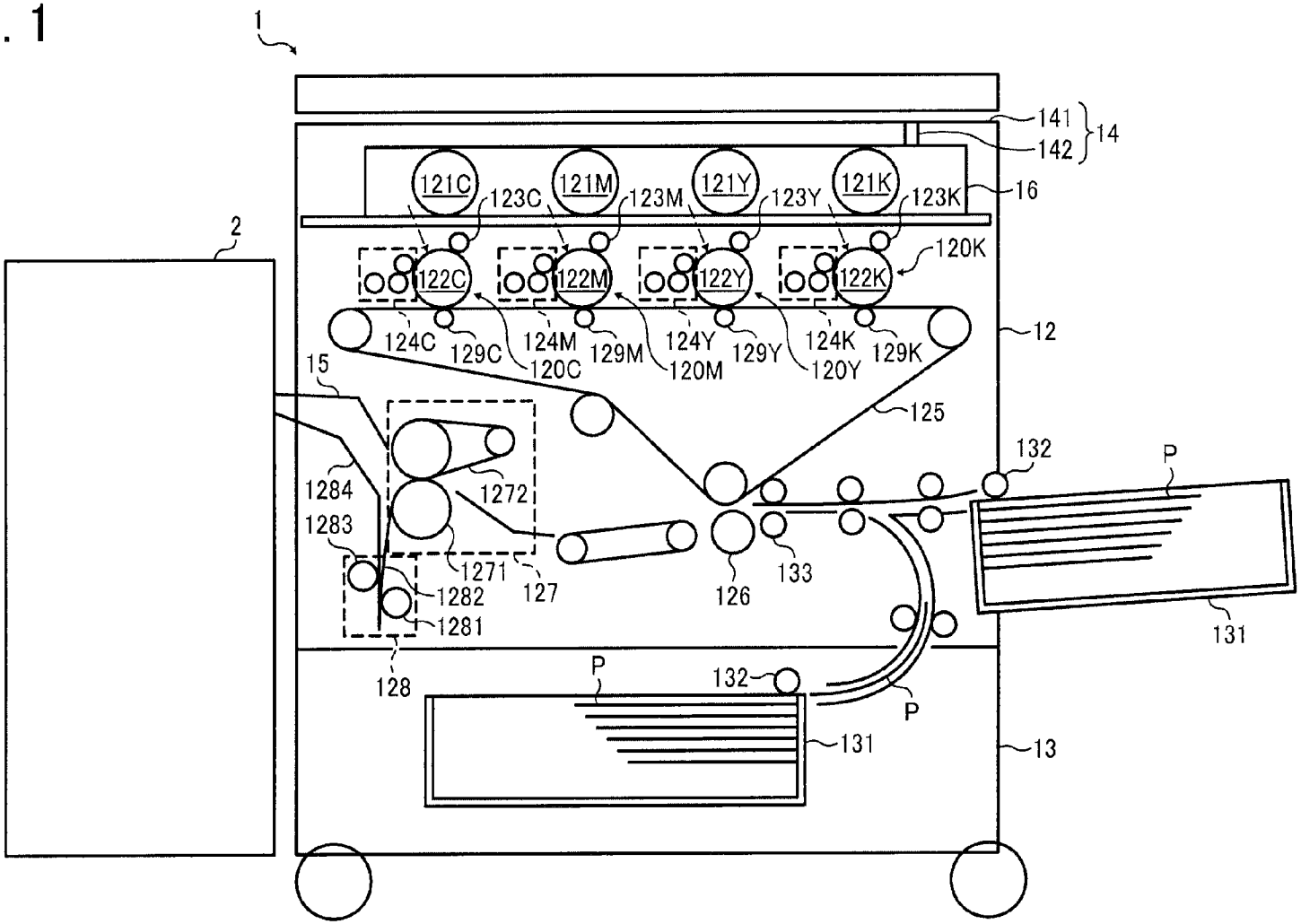
FIG. 1 is a schematic view illustrating an image forming apparatus equipped with an image glossing apparatus of the present invention.

As illustrated in FIG. 1, an image glossing apparatus 2, which is an example of the image glossing apparatus of the present invention, is connected with an image forming apparatus 1, and a recording sheet P, which bears a fixed toner image thereon and which is discharged from the image forming apparatus 1 is fed to the image glossing apparatus 2. In this regard, the image forming apparatus 1 receives a variety of information from an information processor 3 (illustrated in FIG. 5) via a communication network or the like.

Next, the hardware construction of the image forming apparatus 1 and the hardware construction of the image processor 3 transmitting a variety of information to the image forming apparatus 1 will be described.

Figure 2:
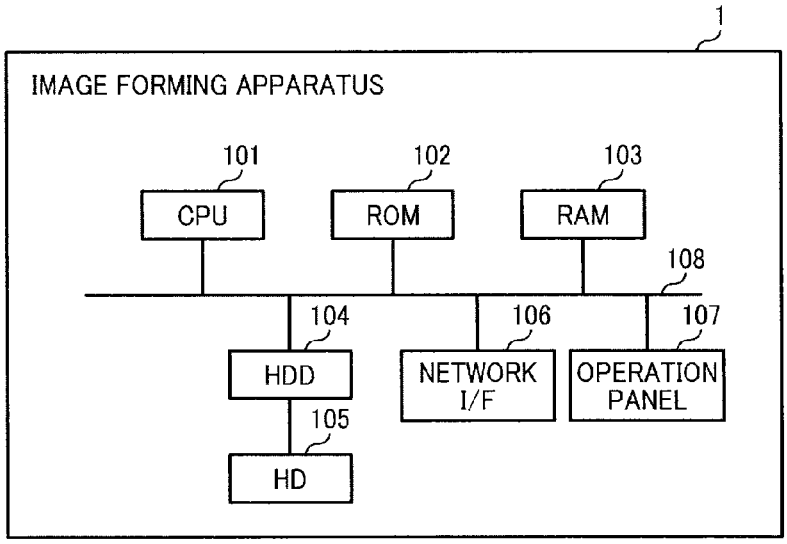
FIG. 2 is a block diagram illustrating a controller of the image forming apparatus and the image glossing apparatus illustrated in FIG. 1.
Figure 3:
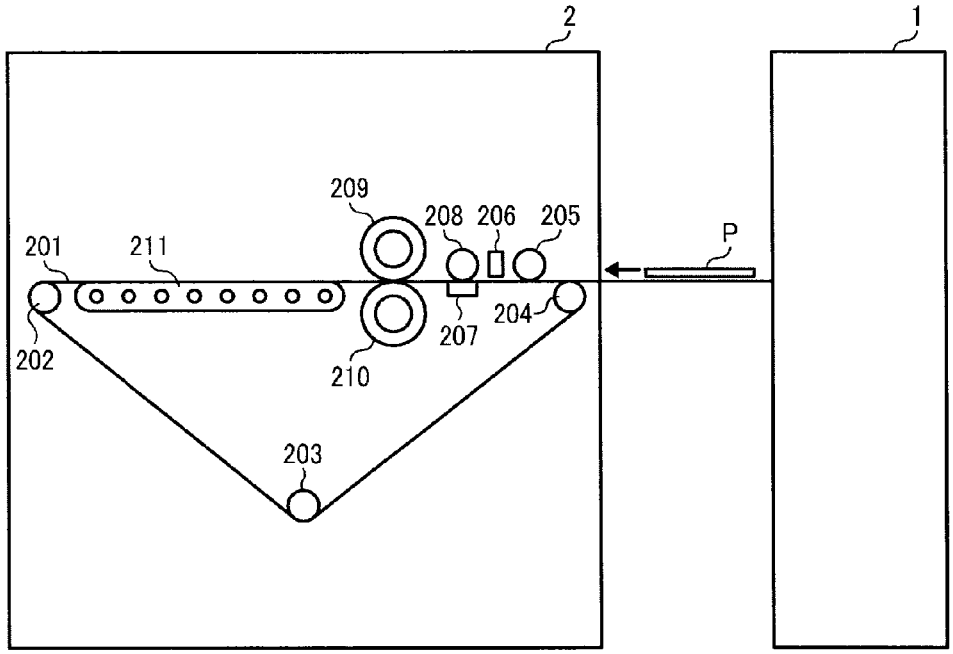
FIG. 3 is a schematic view illustrating an example of the image glossing apparatus of the present invention.
Figure 4:
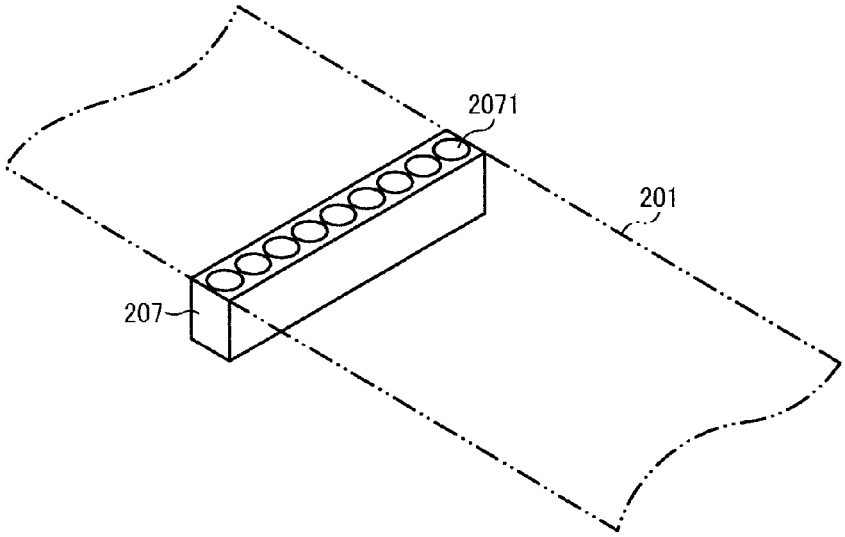
FIG. 4 is a schematic view illustrating a heater of the image glossing apparatus illustrated in FIG. 3.
Figure 5:
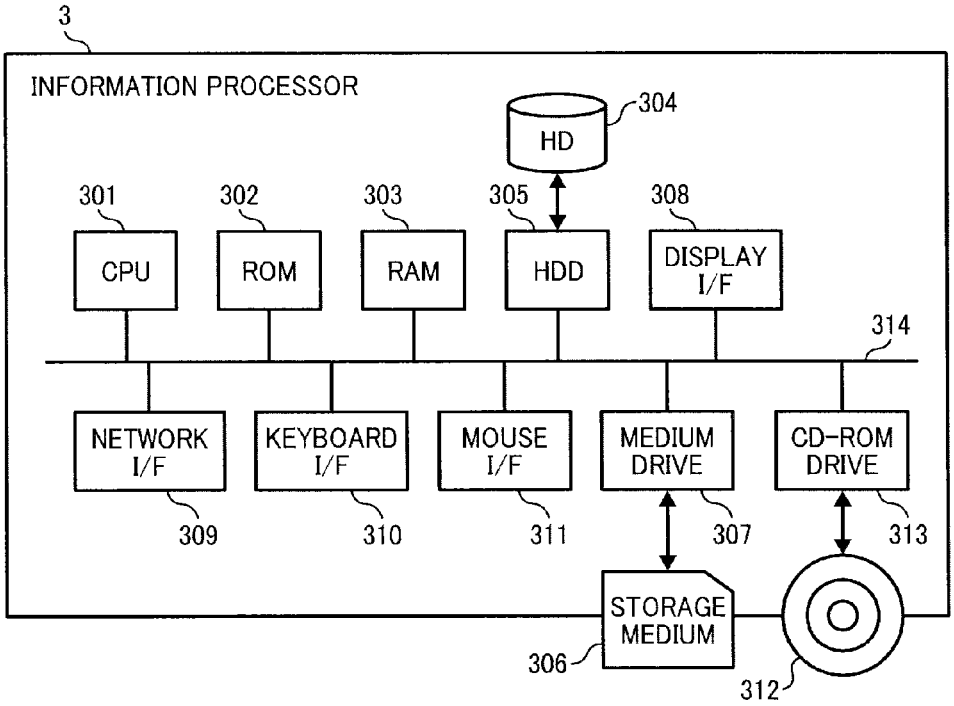
FIG. 5 is a block diagram illustrating an information processor to transmit a variety of information to the image forming apparatus.

FIG. 1 is a schematic view illustrating hardware construction of the image forming apparatus 1. FIG. 2 is a schematic view illustrating hardware construction of a controller of the image forming apparatus 1. FIG. 3 is a schematic view illustrating hardware construction of the image glossing apparatus 2. FIG. 4 is a schematic view illustrating a heater of the image glossing apparatus illustrated in FIG. 3. FIG. 5 is a schematic view illustrating hardware construction of the image processor 3.

Referring to FIG. 1, the image forming apparatus 1 includes a controller (illustrated in FIG. 2), a printing section 12, a sheet feeder 13, a scanner 14, a sheet discharger 15, and an irradiator 16.

Initially, the hardware construction of the controller of the image forming apparatus 1 will be described by reference to FIG. 2. The controller includes a CPU (central processing unit) 101, a ROM (read only memory) 102, a RAM (random access memory) 103, a HDD (hard disk drive) 104, a HD (hard disk) 105, a network I/F (interface) 106, an operation panel 107, and a bus line 108.

The CPU 101 executes programs. The ROM 102 stores information on a system start-up program. The RAM 103 is used as a working area when the CPU 101 executes programs. The HDD 104 controls reading of data from the HD 105 and writing of data in the HD 105. The HD 105 is a memory to store data, and can be replaced with an external storage device such as CD-ROMs (compact disc read only memory), CD-R (compact disc recordable), and DVD (digital versatile disc). The image forming apparatus 1 uses the network I/F 106 when transmitting a variety of information to external devices such as the information processor 3 and receiving information from the external devices. The operation panel 107 is used when the image forming apparatus 1 receives input from users. The bus line 108 connects the above-mentioned devices with each other.

In this regard, the programs are not necessarily stored in the ROM 102, and it is possible to record the programs in a computer-readable memory such as CD-ROM, CD-R and DVD in an installable form or an executable form.

Referring back to FIG. 1, the hardware construction of the printing section 12 will be described.

The printing section 12 includes four image forming devices 120 (120C, 120M, 120Y and 120K) for respectively forming cyan, magenta, yellow and black color toner images, and four toner cartridges 121 (121C, 121M, 121Y and 121K). The image forming devices 120 include photoreceptor drums 122 (122C, 122M, 122Y and 122K), chargers 123 (123C, 123M, 123Y and 123K) to charge the respective photoreceptor drums 122, and developing devices 124 (124C, 124M, 124Y and 124K) to develop electrostatic latent images on the photoreceptor drums 122 with the cyan, magenta, yellow and black toners to form cyan, magenta, yellow and black color toner images on the respective photoreceptor drums 122. The printing section 12 further includes an intermediate transfer belt 125, a secondary transfer roller 126, a fixing device 127, and a sheet reversing device 128. The fixing device 127 includes a pressure roller 1271, and a fixing belt 1272. The reversing device 128 includes a first reversing roller 1281, a first reversing belt 1282, a second reversing roller 1283, and a second reversing belt 1284.

The four toner cartridges 121C, 121M, 121Y and 121K respectively contain the cyan (C) toner, the magenta (M) toner, the yellow (Y) toner, and the black (K) toner to supply the cyan, magenta, yellow and black toners to the respective developing devices 124. Hereinafter the suffix (C, M, Y or K) is sometimes omitted when any one of the devices is described or all the devices are described as a whole.

A surface of the photoreceptor drum 122 is evenly charged by the charger 123, and the charged surface of the photoreceptor drum 122 is irradiated with light emitted by the irradiator 16 according to image information sent from the controller of the image forming apparatus 1, resulting in formation of an electrostatic latent image on the surface of the photoreceptor drum 1. The developing device 124 develops the electrostatic latent image with a toner to form a toner image on the photoreceptor drum 122. Thus, cyan, magenta, yellow and black toner images are formed on the respective photoreceptor drums 122C, 122M, 122Y and 122K.

The charger 123 contacts the surface of the photoreceptor drum 122 to apply a voltage to the surface according to information on the dot area ratio determined by a dot area ratio determining part 112, thereby charging the surface of the photoreceptor drum 122.

The developing device 124 adheres a toner to an electrostatic latent image formed on the photoreceptor drum 122. Therefore, cyan, magenta, yellow and black toner images are formed on the surfaces of the respective photoreceptor drums 122C, 122M, 122Y and 122K.

Since the intermediate transfer belt 125 is rotated while contacted with the photoreceptor drums 122 at primary transfer regions by primary transfer rollers 129C, 129M, 129Y and 129K, the toner images formed on the photoreceptor drums 122C, 122M, 122Y and 122K are primarily transferred to the intermediate transfer belt 125, thereby forming a combined color toner image, in which the C, M, Y and K color toner images are overlaid, on the surface of the intermediate transfer belt 125. The combined color toner image on the intermediate transfer belt 125 is transferred onto the recording sheet P at a secondary transfer region by the secondary transfer roller 126.

The secondary transfer roller 126 sandwiches the recording sheet P fed from the sheet feeder 13 (described later in detail) to transfer the combined color toner image onto the recording sheet P while feeding the recording sheet P to the fixing device 127.

The fixing device 127 fixes the toner image onto the recording sheet P using the pressure roller 1271 and the fixing belt 1272. The pressure roller 1271 presses the recording sheet P toward the fixing belt 1272 while applying heat thereto to fix the toner image onto the recording sheet P. The fixing belt 1272 contacts the surface of the recording sheet P bearing the toner image while applying heat thereto to fix the toner image onto the surface of the recording sheet P.

The reversing device 128 reverses the recording sheet P bearing the fixed toner image and fed from the fixing device 127. The first reversing roller 1281 of the reversing device 128 moves the first reversing belt 1282 to feed the recording sheet P. The second reversing roller 1283 moves the second reversing belt 1284, which is arranged so as to be opposed to the first reversing belt 1282, in a direction opposite to the moving direction of the first reversing belt 1282. The second reversing belt 1284 feeds the recording sheet P toward the image glossing apparatus 2.

The recording sheet P, to which the toner image is fixed by the fixing device 127, is fed in such a manner that the backside of the recording sheet is contacted with the first reversing belt 1282. When the first reversing belt 1282 is stopped at a predetermined position, and then the second reversing belt 1284 is moved in the direction opposite to the moving direction of the first reversing belt 1282, the recording sheet P is fed toward the image glossing apparatus 2 in such a manner that the surface of the recording sheet P bearing the fixed toner image thereon is contacted with the second reversing belt 1284. Thus, the recording sheet P is fed to the image glossing apparatus 2 while reversed.

Next, the sheet feeder 13 will be described. The sheet feeder 13 feeds the recording sheet P to the printing section 12, and includes a sheet tray 131, a feeding roller 132, and a registration roller 133.

Each of the sheet trays 131 contains the recording sheets P. The feeding roller 132 picks up the uppermost recording sheet of the recording sheets P contained in the sheet tray 131, and feeds the recording sheet P to the registration roller 133. The registration roller 133 timely feeds the recording sheet P to the secondary transfer region, in which the intermediate transfer belt 125 is contacted with the secondary transfer roller 126, so that the combined toner image on the intermediate transfer belt 125 is transferred onto a proper position of the recording sheet P at the secondary transfer region.

The scanner 14 reads image information of an original document, and includes a glass plate 141 on which an original document to be copied is set, and an optical sensor 142 to read image information of the original document.

The sheet discharger 15 discharges the recording sheet P bearing the fixed toner image thereon, which is prepared by the printing section 12, toward the image glossing apparatus 2.

The irradiator 16 irradiates the charged photoreceptor drums 122 with light according to the image information to form an electrostatic latent image on each of the photoreceptor drums 122.

Next, the hardware construction of the image glossing apparatus 2 will be described by reference to FIG. 3. The image glossing apparatus 2 heats the recording sheet bearing a fixed toner image thereon to melt the toner image, and then contacts the melted toner with a smooth surface of a belt upon application of pressure thereto while cooling the toner image, thereby smoothing the surface of the toner image, resulting in formation of a glossed toner image. The image glossing apparatus 2 has a glosser belt 201, rollers 202, 203 and 204, a measuring roller 205, a sheet detection sensor 206, a partial heater 207, first, second and third pressure rollers 208, 209 and 210, a cooling part 211, and a controller. In this regard, the partial heater 207, the pressure rollers 208-210, and the cooling part 211 serve as a glossing device of the image glossing apparatus of the present invention, which glosses at least a part of the toner image.

The glosser belt 201 is an endless belt rotated while tightly stretched by the rollers 202, 203 and 204 to feed the recording sheet P in the order of the measuring roller 205, the partial heater 207, the first pressure roller 208, the second pressure roller 209, the third pressure roller 210, and the cooling part 211. Since the toner image melted by the partial heater 207 is contacted with the glosser belt 201 upon application of pressure thereto to impart high glossiness to the toner image, the surface of the glosser belt has to be smooth.

The rollers 202, 203 and 204 rotate the glosser belt 201 in a direction while tightly stretching the glosser belt. The measuring roller 205 rotates while sandwiching the recording sheet P with the glosser belt 201. The measuring roller 205 is made of a material having such a friction coefficient that the measuring roller 205 is rotated by the recording sheet P fed by the glosser belt 201 (i.e., the recording sheet P does not slip on the surface of the measuring roller 205).

The sheet detection sensor 206 detects whether the tip of the recording sheet P reaches a predetermined position in the feeding direction of the recording sheet P, and includes a light source such as a LED (light emitting diode) and a LD (laser diode), and a detector to detect light emitted by the light source and reflected from the recording sheet P. The predetermined position mentioned above is a position located between the partial heater 207 and the contact point of the measuring roller 205 and the glosser belt 201. In this regard, the sheet detection sensor 206 serves as a tip detector.

The partial heater 207 heats toner images fixed on the recording sheet P using heat generated by a heater. As illustrated in FIG. 4, the partial heater 207 has configuration such that small heating parts 2071 are arranged in a direction perpendicular to the feeding direction of the recording sheet P, and one of the heating parts 2071 heats a unit portion b of the recording sheet P to be heated according to glossiness information (mentioned later). When the partial heater 207 partially heats the recording sheet P bearing a toner image, the temperature of the toner constituting the toner image is increased, and the toner is softened, resulting in decrease of the viscoelasticity of the toner. The partial heater 207 serves as a heater of the glossing device of the image glossing apparatus of the present invention.

The first pressure roller 208 applies a pressure to a portion of the recording sheet P, which is present between the first pressure roller 208 and the glosser belt 201 when the portion is heated by the partial heater 207. The first pressure roller 208 is arranged so as to be opposed to the partial heater 207. Since the toner of the toner image, which is heated by the partial heater 207 so as to decrease the viscoelasticity thereof, is sandwiched by the first pressure roller 208 and the glosser belt 201 upon application of a pressure thereto, the surface of the toner image is smoothed.

The second and third pressure rollers 209 and 210 evenly press the recording sheet P partially heated by the partial heater 207 so that the toner image is pressured to the glosser belt 201, thereby further smoothing the surface of the toner image, which has been smoothed by the combination of the partial heater 207 and the first pressure roller 208. In this regard, it is preferable that the second and third pressure rollers 209 and 210 heat the toner image to an extent such that the temperature of the toner of the toner image is maintained, because solidification of the toner can be avoided and the surface of the toner image can be effectively smoothed.

Since the cooling part 211 cools the heated and pressed toner of the toner image on the recording sheet P, the temperature of the toner is decreased so as to be lower than the glass transition temperature of the toner, and therefore the toner is solidified while maintaining the smooth surface. Specific examples of the cooling device constituting the cooling part 211 include any known coolers such as air cooling devices having a fan, liquid cooling devices using a liquid jacket, a radiator, or a fan, and heat pump type cooling devices using a cooling medium or a heat pump. Cooling the toner image can be performed after or while pressing the toner image.

The partial heater 207 serves as a heater, the combination of the second and third pressure rollers 209 and 210 serves as a pressurizer, and the cooling part 211 serves as a cooler. In addition, the glosser belt 201 serves as a smoother, and the measuring roller 205 serves as a rotor.

Since the hardware construction of the controller of the image glossing apparatus 2 is the same as the hardware construction of the controller of the image forming apparatus 1 except that a program of imparting glossiness used for controlling the image glossing apparatus 2 is stored in the ROM 102, detailed description thereof is omitted here.

Next, the hardware construction of the information processor 3 will be described by reference to FIG. 5.

The information processor 3 includes a CPU 301 to control of the operation of the entire of the information processor 3, a ROM 302 to store an information processing program, a RAM 303 used as a work area of the CPU 301, a HD 304 to store a variety of data, a HDD 305 to control reading of data from the HD 304 and writing of data in the HD 304 under the control of the CPU 301, a media drive 307 to control reading of data from a storage medium 306 and writing of data in the storage medium 306, a display I/F 308 to display a variety of information such as information on cursor, menu, window and image in a display, a network I/F 309 to perform data transmission using a communication network, a keyboard I/F 310 to control a keyboard having plural keys used for inputting characters, numbers and a variety of instructions, a mouse I/F 311 to control a mouse used for a variety of operations such as selection or execution of an instruction, selection of a matter to be processed, and movement of cursor, a CD-ROM drive 313 to control reading of data from a CD-ROM 312, which serves as a detachably attachable storage medium, and writing of data in the CD-ROM 312, and a bus line 314 (such as address buses and data buses) to electrically connect the above-mentioned devices with each other.

In this regard, the information processing program is not necessarily stored in the ROM 302, and it is possible to record a program in an installable form or an executable form in a computer-readable memory such as the storage medium 306 and the CD-ROM 312.

Next, the functional constructions of the image forming apparatus 1, the image glossing apparatus 2, and the information processor 3 will be described by reference to FIGS. 6-10.

Figure 6:
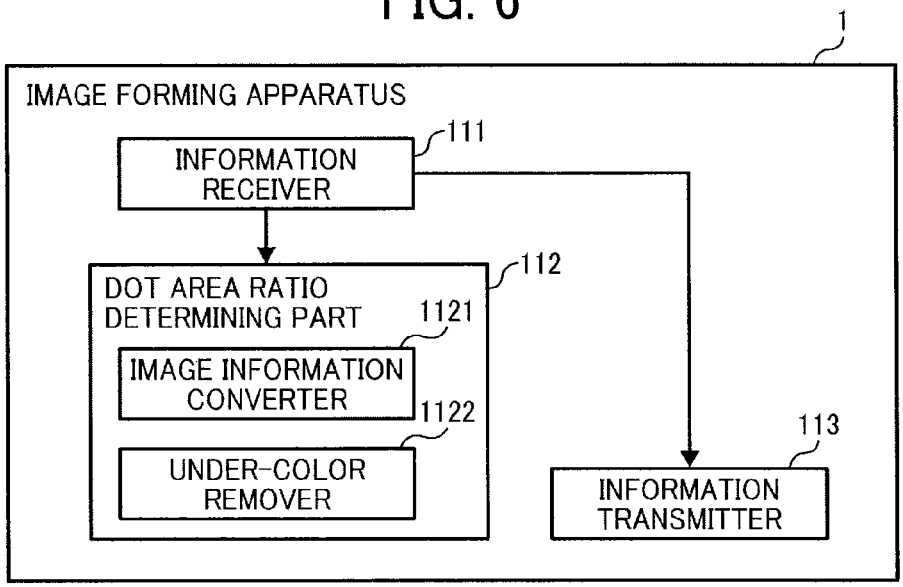
FIG. 6 is a function block diagram illustrating a controller of the image forming apparatus.
Figure 7:
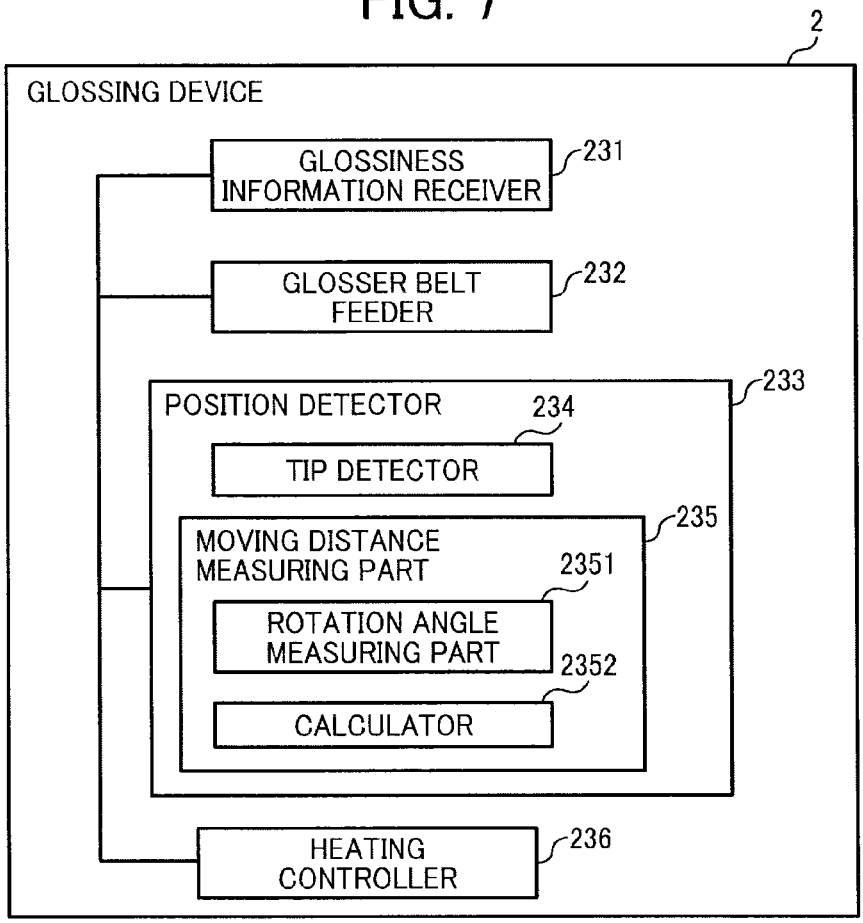
FIG. 7 is a function block diagram illustrating a controller of the image glossing apparatus.
Figure 8:
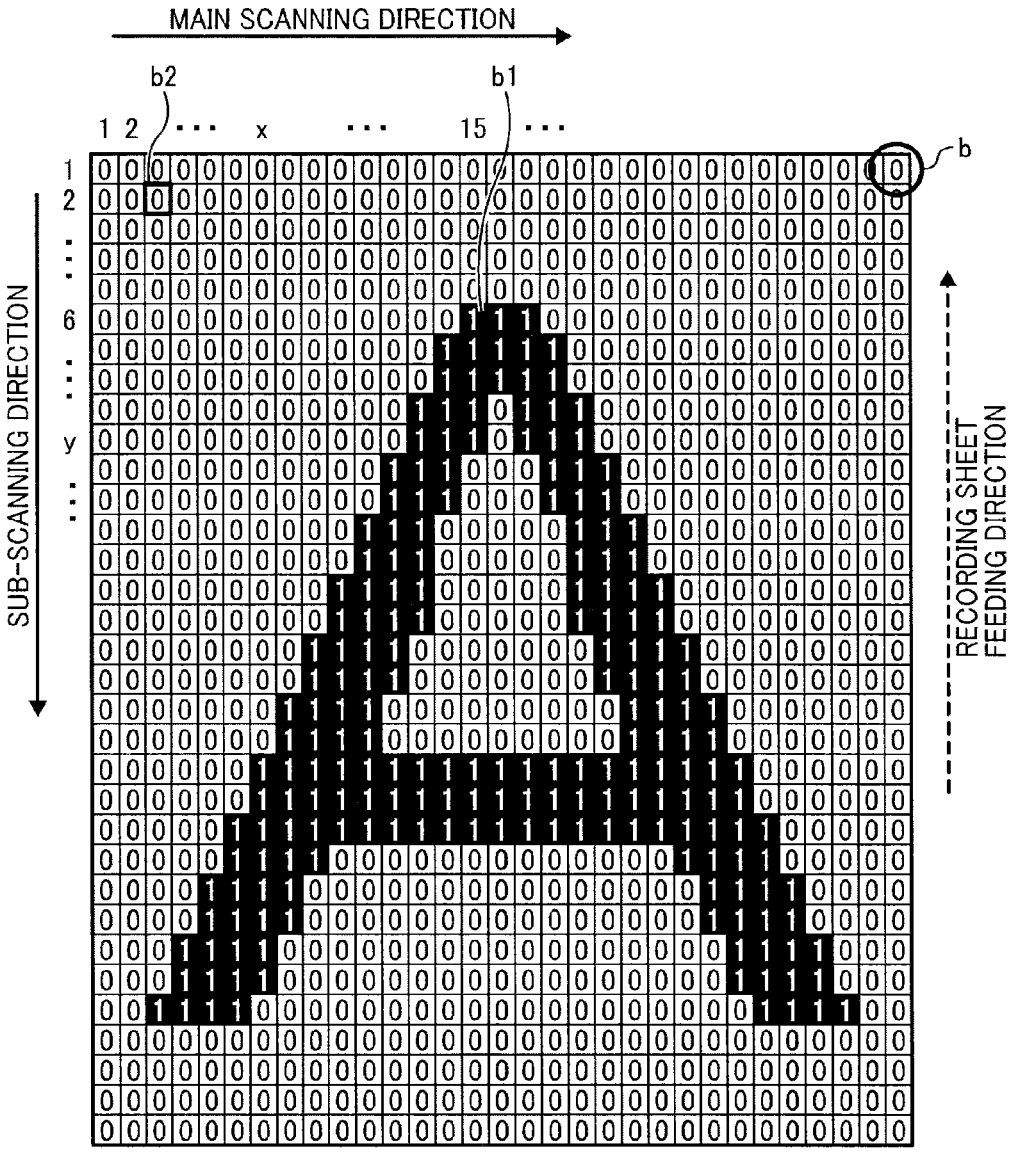
FIG. 8 is a schematic view for describing glossiness information on an image.
Figure 9:
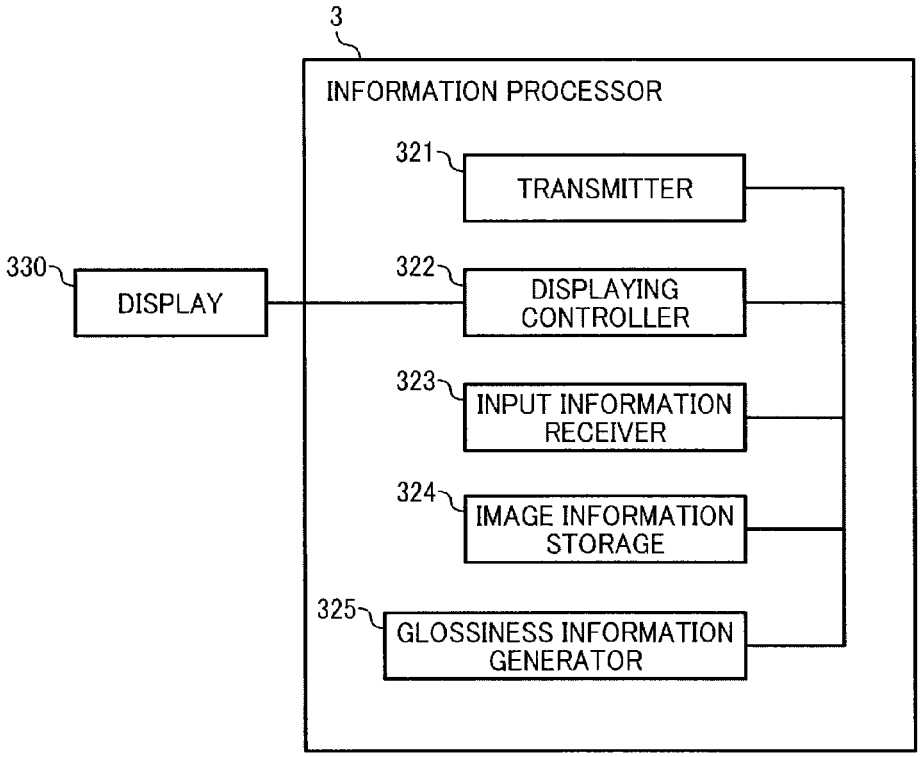
FIG. 9 is a function block diagram illustrating the information processor illustrated in FIG. 5.
Figure 10:
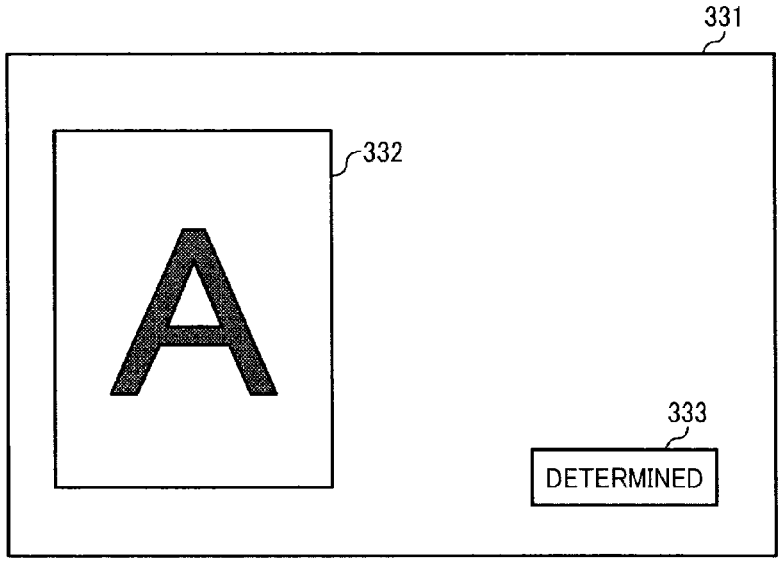
FIG. 10 is a schematic view illustrating an interface image through which glossiness information is input.

FIG. 6 is a function block diagram illustrating a controller of the image forming apparatus 1. FIG. 7 is a function block diagram illustrating a controller of the image glossing apparatus 2. FIG. 8 is a schematic view for describing the glossiness information on an image. FIG. 9 is a function block diagram illustrating the information processor 3. FIG. 10 is a schematic view illustrating an interface image through which glossiness information is input.

Initially, the functional construction of the image forming apparatus 1 will be described by reference to FIG. 6. Referring to FIG. 6, the controller of the image forming apparatus 1 includes an information receiver 111, the dot area ratio determining part 112, and an information transmitter 113. The dot area ratio determining part 112 includes an image information converter 1121, and an under-color remover 1122. The information receiver 111, the dot area ratio determining part 112, and the information transmitter 113 are operated according to instructions from the CPU 101, which are stored in the ROM 102 (illustrated in FIG. 2) as a program.

The information receiver 111 receives image information and glossiness information, which are transmitted from the information processor 3 through a communication network or the like. In this regard, the image information is information on an image to be formed on a recording sheet, and includes electric color separation image signals of red (R), green (G) and blue (B) color images. Hereinafter, the image information is referred to as RGB image information. The glossiness information will be described later.

The dot area ratio determining part 112 determines dot area ratios Rc, Rm, Ry and Rk (hereinafter referred to as image formation information) of cyan, magenta, yellow and black toner images based on the RGB image information which the information receiver 111 receives. The dot area ratio determining part 112 includes the image information converter 1121 and the under-color remover 1122. The image information converter 1121 performs a RIP (raster image processing) to perform a color space conversion processing on the RGB image information, thereby determining dot area ratios Rc0, Rm0 and Ry0 of cyan, magenta and yellow toner images in a unit area. The under-color remover 1122 performs an under-color removal processing on each of the C, M and Y dot area ratios Rc0, Rm0 and Ry0 determined by the image information converter 1121, thereby determining the dot area ratios Rc, Rm, Ry and Rk. Thus, the processings are performed by the image information converter 1121 and the under-color remover 1122, and therefore the image formation information is provided.

The dot area ratio is a ratio (A1/A0) of the total area (A1) of portions of a recording sheet, on which a color toner dot image (C, M, Y or K dot image) is to be formed, to the area (A0) of the entire of the recording sheet. Namely, when the dot area ratio is 0%, the toner is not adhered to the portion of the recording sheet, and when the dot are ratio is 100%, the toner is adhered to the entire surface of the potion.

The information transmitter 113 is constituted of the network I/F, which is illustrated in FIG. 2, or the like, and transmits information including glossiness information to the image glossing apparatus 2.

Next, the functional construction of the controller of the image glossing apparatus 2 will be described by reference to FIG. 7. Referring to FIG. 7, the image glossing apparatus 2 includes a glossiness information receiver 231, a glosser belt feeder 232, a position detector 233, and a heating controller 236. The position detector 233 includes a tip detector 234 to detect the tip of the recording sheet P, and a moving distance measuring part 235, which measures the moving distance of the recording sheet P fed by the glosser belt feeder 232 and which includes a rotation angle measuring part 2351 to measure the angle of the rotated measuring roller 205, and a calculator 2352 to calculate the moving distance of the recording sheet P. The glossiness information receiver 231, the glosser belt feeder 232, and the position detector 233 are operated according to instructions from the CPU 101, wherein the instructions are stored in the ROM 102 (illustrated in FIG. 2) as a program.

The glossiness information receiver 231 receives glossiness information transmitted from the information transmitter 113 of the image forming apparatus 1. The glossiness information receiver 231 serves as a glossiness information obtaining device.

In this regard, glossiness information includes information on the position of a portion (glossing portion) of the recording sheet P in which a glossy image is to be formed, and information on the position of a portion (non-glossing portion) of the recording sheet in which a glossy image is not to be formed.

The glossiness information will be described in detail by reference to FIG. 8. FIG. 8 illustrates a recording sheet on which an image is to be formed, and a recording sheet feeding direction is illustrated by a dotted line. In addition, each of a main scanning direction, and a sub-scanning direction is illustrated by a solid line. Further, the position of each of unit portions b can be determined by using an X-coordinate (parallel to the man scanning direction) and a Y-coordinate (parallel to the sub-scanning direction). In this regard, one of the unit portions b can be heated by one of the heating parts 2071 of the partial heater 207.

Referring to FIG. 8, a character "A" formed on a recording sheet is a portion to be glossed, and a unit portion b on the character A is a heating unit portion b1, which is to be heated by the heating part 2071 of the partial heater 207 and to which a glossiness flag 1 is assigned. In addition, a unit portion b on the background of the character A is a non-heating unit portion b2, which is not to be heated by the heating part 2071 of the partial heater 207 and to which a glossiness flag 0 is assigned. The information in which the glossiness flag 1 or 0 is assigned to each of the unit portions b is the glossiness information. In the example illustrated in FIG. 8, a unit portion b having an X,Y-coordinate value (3,2) is a non-heating unit portion b2 having a glossiness flag of 0, and a unit portion b having an X,Y-coordinate value (15,6) is a heating unit portion having a glossiness flag of 1. In this example, the information processor 3 provides the glossiness information. The glossiness information providing processing will be described later in detail. In this regard, the CPU 101 of the image glossing apparatus 2 serves as the glossiness information receiver 231, which serves as a glossiness information obtaining device of the image glossing apparatus of the present invention.

The glosser belt feeder 232 circulates the glosser belt 201 by rotating the rollers 202, 203 and 204 to feed the recording sheet P on the glosser belt 201. Specifically, the glosser belt feeder 232 feeds the recording sheet P, which has a fixed toner image thereon and which is discharged by the sheet discharger 15 of the image forming apparatus 1 and inserted into the image glossing apparatus 2 through an entrance thereof, toward the partial heater 207. In this regard, the combination of the glosser belt 201 and the rollers 202-204 serves as the glosser belt feeder 232, which serves as a recording sheet feeder of the image glossing apparatus of the present invention.

The position detector 233 measures the distance between the tip (front end) of the recording sheet P and a portion of the recording sheet P, with which the partial heater 207 is contacted. The tip detector 234 of the position detector 233 includes the sheet detection sensor 206, and detects whether the tip of the recording sheet P reaches the partial heater 207. In this regard, the sheet detection sensor 206 serves as the tip detector 234, which serves as a tip detector of the image glossing apparatus of the present invention, and the calculator 2352 (i.e., the CPU 101 in this example) serves as the position detector 233, which serves as a position detector of the image glossing apparatus of the present invention.

The moving distance measuring part 235 measures the moving distance of the recording sheet P fed by the glosser belt feeder 232, and includes the rotation angle measuring part 2351 and the calculator 2352. The rotation angle measuring part 2351 measures the rotation angle of the measuring roller 205 from a time, in which the tip detector 234 detects the tip of the recording sheet P, to determine the moving distance of the recording sheet P in the recording sheet feeding direction. In this regard, the measuring roller 205 serves as the moving distance measuring part 235, which serves as a distance measuring device of the image glossing apparatus of the present invention, and the rotation angle measuring part 2351 serves as an angle measuring device of the image glossing apparatus of the present invention.

The calculator 2352 calculates the moving distance of the recording sheet P (i.e., the distance between the tip of the recording sheet P and the portion of the recording sheet with which the partial heater 207 is contacted) based on the rotation angle of the measuring roller 205, which is measured by the rotation angle measuring part 2351, and the peripheral length of the measuring roller 205.

The heating controller 236 controls the partial heater 207 to heat the portion of the recording sheet P, with which the partial heater 207 is contacted, if the portion is to be glossed. The heating controller 236 serves as a heating controlling device, which serves as a part of the heater of the image glossing apparatus of the present invention.

Next, the functional construction of the information processor 3 will be described by reference to FIG. 9. Referring to FIG. 9, the information processor 3 includes a transmitter 321, a displaying controller 322, an input information receiver 323, an image information storage 324, and a glossiness information generator 325. The transmitter 321, the displaying controller 322, the input information receiver 323, and the glossiness information generator 325 are operated according to instructions from the CPU 301, wherein the instructions are stored in the ROM 302 (illustrated in FIG. 5) as a program. The image information storage 324 includes the HD 304 illustrated in FIG. 5.

The transmitter 321 includes the network I/F 309 illustrated in FIG. 5, and transmits a variety of information to the image forming apparatus 1 through a communication network. The displaying controller 322 includes the display I/F 308 illustrated in FIG. 5, and controls a display 330 to display a variety of information. The input information receiver 323 includes the keyboard I/F 310 and the mouse I/F 311, and receives a variety of information input by users using a keyboard or a mouse.

The image information storage 324 stores image information on an image to be formed on the recording sheet P. The glossiness information generator 325 generates glossiness information on the image, whose image information is stored in the image information storage 324, according to the input information received by the input information receiver 323. Specifically, the glossiness information generator 325 generates glossiness information including the positions of glossing portions of the recording sheet P and the positions of non-glossing portions thereof.

FIG. 10 is a schematic view illustrating an interface image 331, through which a user can input glossiness information and which is displayed in the display 330 by the display controller 322. The interface image 331 includes a glossing portion selecting part 332, and a determination button 333. The glossing portion selecting part 332 displays an image according to the RGB image information, and a user selects a glossing portion of the image using a mouse or the like. In this case, it is assumed that the character "A" is selected as a glossing portion, and then the determination button 333 is pushed by the user.

The glossiness information generator 325 assigns a glossiness flag 1 to the heating unit portions b1 (illustrated in FIG. 8), which are to be glossed, while assigning a glossiness flag 0 to the non-heating unit portions b2, which are not to be glossed. Thus, the glossiness information generator 325 assigns a glossiness flag 1 or 0 to each of all the unit portions b, resulting in generation of the glossiness information.

Figure 11:
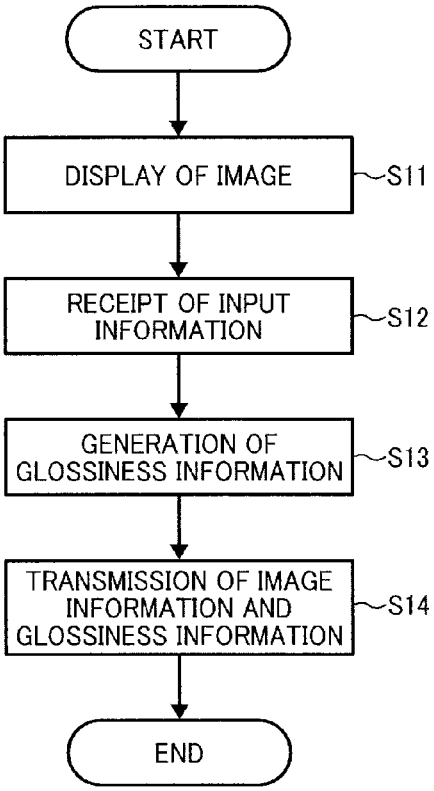
FIG. 11 is a flowchart illustrating an information processing of the information processor illustrated in FIG. 9.
Figure 12:
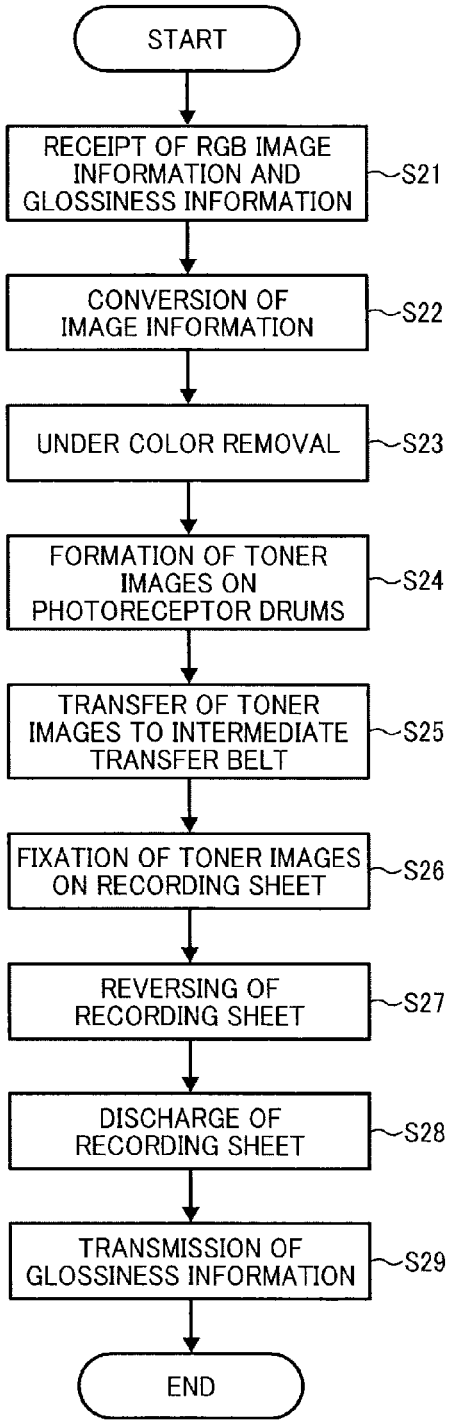
FIG. 12 is a flowchart illustrating an image forming operation of the image forming apparatus illustrated in FIG. 1.
Figure 13:
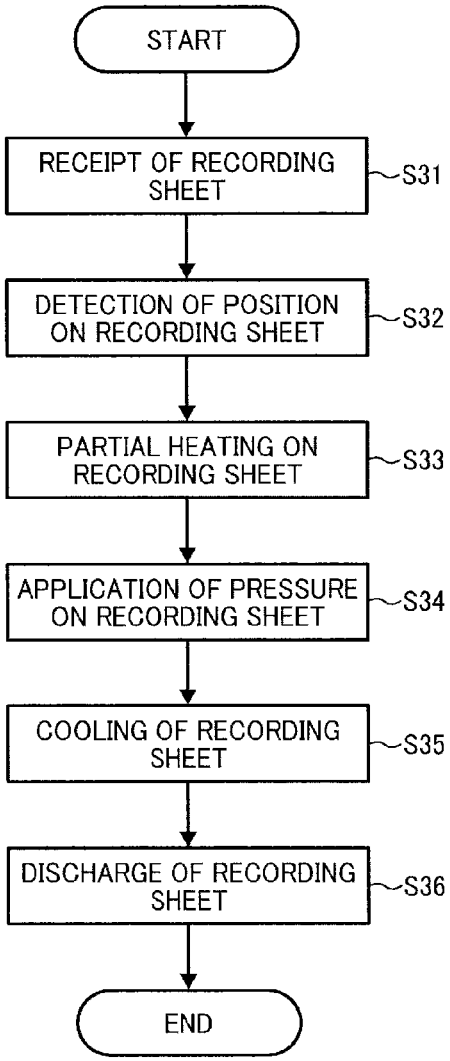
FIG. 13 is a flowchart illustrating an image glossing operation of the image glossing apparatus illustrated in FIG. 7.
Figure 14:
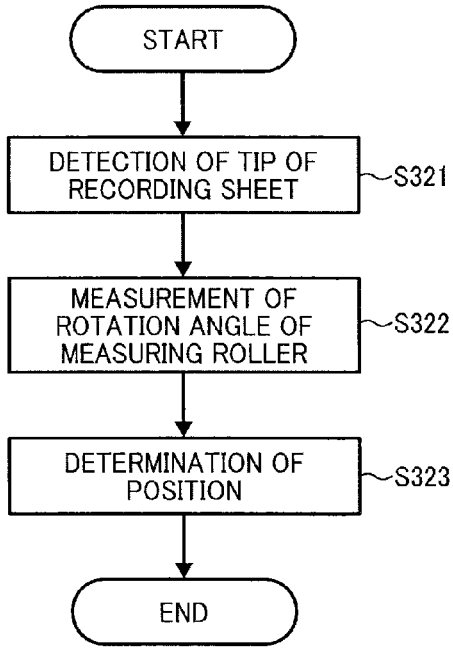
FIG. 14 is a flowchart illustrating an operation for measuring the moving distance of a recording sheet in the image glossing apparatus illustrated in FIG. 3.
Figure 15:
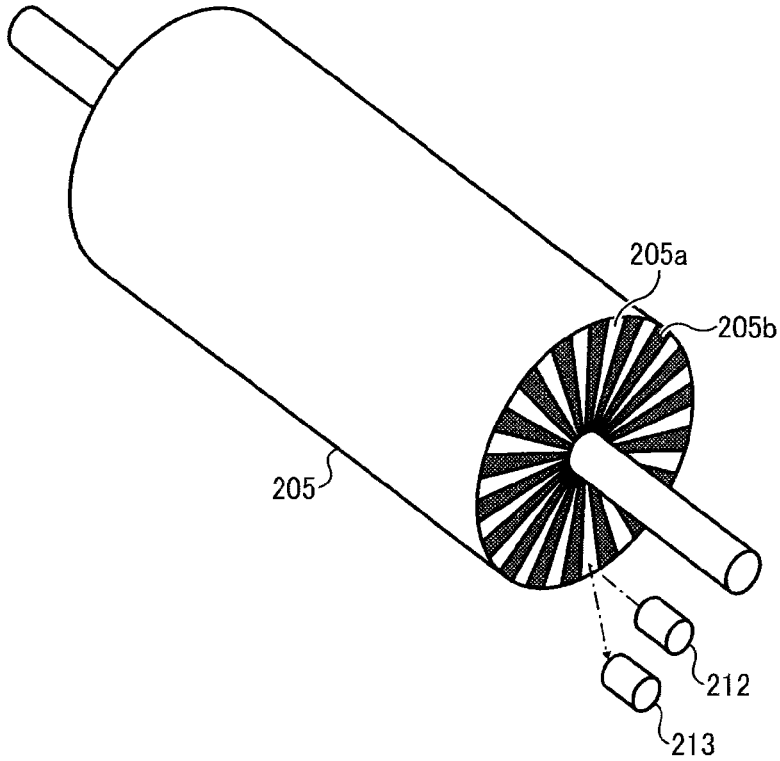
FIG. 15 is a schematic view for describing a method for measuring rotation angle of a measuring roller used for measuring the moving distance of a recording sheet.
Figure 16:
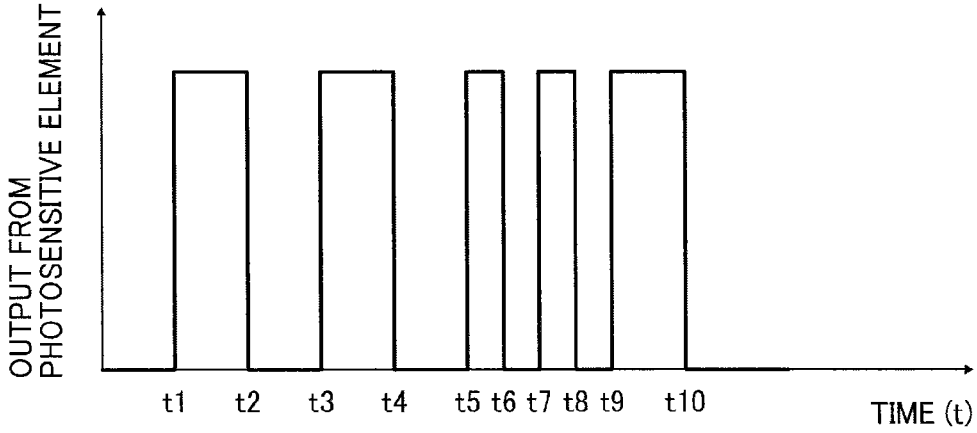
FIG. 16 is a schematic view illustrating an example of output from a photosensitive element used for measuring the moving distance of a recording sheet.
Figure 17A:
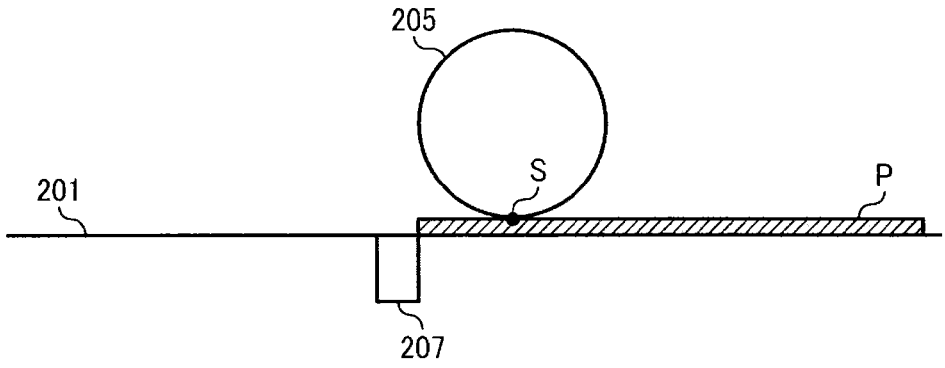
FIGS. 17A-17C are schematic views for describing a way to determine the moving distance of a recording sheet.
Figure 17B:
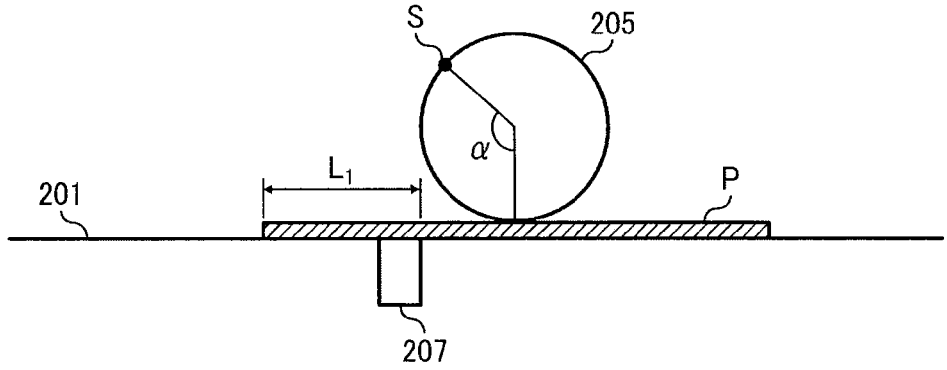
Figure 17C:
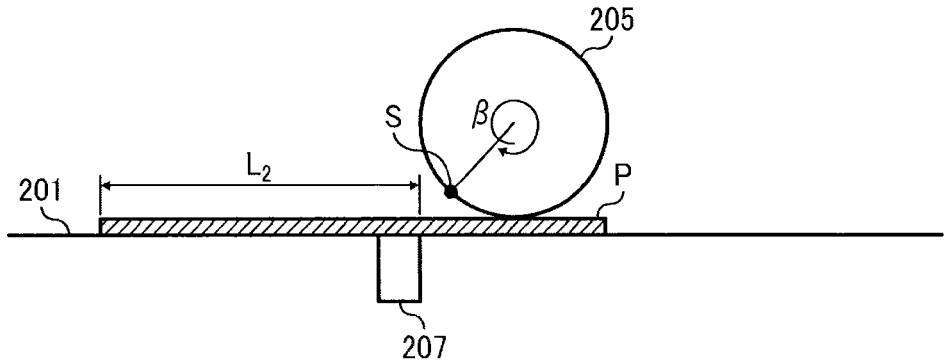
Figure 18:
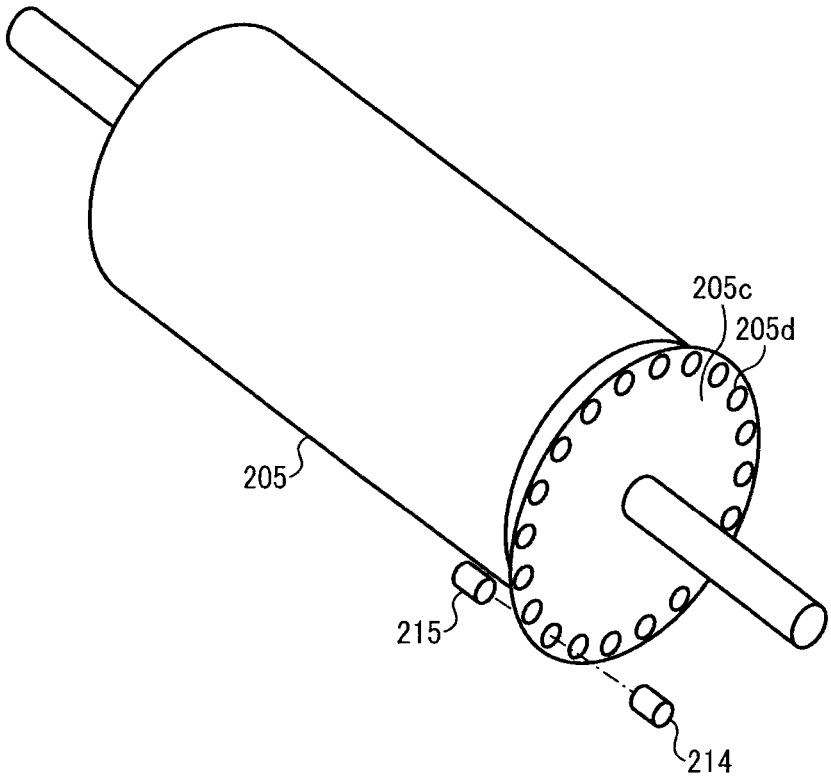
FIG. 18 is a schematic view for describing another method for measuring rotation angle of a measuring roller used for measuring the moving distance of a recording sheet.

Next, other processings for use in the present invention will be described by reference to FIGS. 11-18. FIG. 11 is a flowchart illustrating an information processing of the information processor 3. FIG. 12 is a flowchart illustrating an image forming operation of the image forming apparatus 1. FIG. 13 is a flowchart illustrating an image glossing operation of the image glossing apparatus 2. FIG. 14 is a flowchart illustrating an operation of measuring the moving distance of the recording sheet P in the image glossing apparatus 2. FIG. 15 is a schematic view for describing a method for measuring the rotation angle of the measuring roller used for measuring the moving distance of the recording sheet P. FIG. 16 is a schematic view illustrating an example of output from a photosensitive element used for measuring the moving distance of the recording sheet P. FIGS. 17A-17C are schematic views for describing a way to determine the moving distance of the recording sheet P. FIG. 18 is a schematic view for describing another method for measuring the rotation angle of the measuring roller 205 used for measuring the moving distance of the recording sheet P.

As illustrated in FIG. 11, the displaying controller 322 of the information processor 3 performs controlling such that an image is displayed in the glossing portion selecting part 332 of the interface image 331 in the display 330 according to the RGB image information stored in the image information storage 324 (step S11). The user designates the glossing portion of the image in the interface image 331 using a mouse or a keyboard, and then pushes the determination button 333. As mentioned above, it is assumed that the character "A" is selected as the glossing portion. When the user pushes the determination button 333, the input information receiver 323 receives the information on the glossing portion as the input information (step S12).

Next, the glossiness information generator 325 assigns a glossiness flag 1 to each of heating unit portions b1 according to the input information received by the input information receiver 323 as illustrated in FIG. 8. In addition, the glossiness information generator 325 assigns a glossiness flag 0 to each of non-heating unit portions b2. Thus, the glossiness information in which a glossiness flag 1 or 0 is assigned to each of all the unit portions b is generated (step S13). The transmitter 321 transmits the RGB image information stored in the image information storage 324 and the glossiness information of the RGB image to the image forming apparatus 1 through a communication network (step S14).

When the transmitter 321 of the information processor 3 transmits the RGB image information and the glossiness information to the image forming apparatus 1 through a communication network, the information receiver 111 of the image forming apparatus 1 receives the RGB image information and the glossiness information (step S21).

Next, the dot area ratio determining part 112 provides the image formation information based on the RGB image information received by the information receiver 111.

The processing of the dot area ratio determining part 112 will be described. Initially, the image information converter 1121 of the dot area ratio determining part 112 converts the RGB image information to dot area ratios of C, M and Y images. Specifically, the image information converter 1121 performs processings such as shading correction, position aberration correction, color space conversion, and gamma correction to convert the RGB image information to dot area ratios Rc0, Rm0 and Ry0 (step S22). Next, the under-color remover 1122 performs under-color removal on the dot area ratios Rc0, Rm0 and Ry0 (step S23). By performing these processings, the image formation information (i.e., the dot area ratios Rc, Rm, Ry and Rk of C, M, Y and K images) is provided.

Next, the printer section 12 forms an image on the recording sheet P based on the image formation information. Specifically, toner images are formed on the surfaces of the photoreceptor drums 122 based on the image formation information (step S24). More specifically, the chargers 123 are contacted with the surfaces of the photoreceptor drums 122 to apply a voltage, thereby evenly charging the surfaces of the photoreceptor drums 122, and then the irradiator 16 irradiates the charged photoreceptor drums 122 with laser beams according to the image formation information, thereby forming electrostatic latent images on the surfaces of the photoreceptor drums 122. The developing devices 124 develop the electrostatic latent images with C, M, Y and K developers respectively including C, M, Y and K toners, thereby forming C, M, Y and K toner images on the respective photoreceptor drums 122C, 122M, 122Y and 122K.

Next, the intermediate transfer belt 125 is rotated while contacting the photoreceptor drums 122, and therefore the C, M, Y and K toner images formed on the photoreceptor drums 122 are transferred onto the surface of the intermediate transfer belt 125 so as to be overlaid (step S25) by the primary transfer rollers 129, thereby forming a combined color toner image on the intermediate transfer belt 125. After the toner images are primarily transferred to the intermediate transfer belt 125, the surfaces of the photoreceptor drums 122 are subjected to a discharging treatment using a discharger to remove residual charges from the photoreceptor drums 122, and a cleaning treatment using a cleaner to remove residual toners from the photoreceptor drums 122.

Next, the fixing device 127 fixes the combined color toner image, which is transferred to the recording sheet P from the intermediate transfer belt 125, to the recording sheet P (step S26).

Formation of a fixed image on the recording sheet P will be described in detail by reference to FIG. 1. Initially, the feeding roller 132 picks up the outermost recording sheet of the recording sheets P contained in the sheet tray 131 and feeds the recording sheet P to the registration roller 133. The registration roller 133 feeds the recording sheet P to the secondary transfer region formed by the intermediate transfer belt 125 and the secondary transfer roller 126. The recording sheet P is then fed by the intermediate transfer belt 125 and the secondary transfer roller 126, and the combined color toner image on the intermediate transfer belt 125 is transferred onto the recording sheet P at the secondary transfer region. Next, the pressure roller 1271 and the fixing belt 1272 of the fixing device 127 press and heat the recording sheet P bearing the toner image thereon to fix the toner image to the recording sheet P, resulting in formation of a fixed color image on the recording sheet P.

When the fixing device 127 fixes the toner image, the sheet reversing device 128 reverses the recording sheet P (step S27). Specifically, the first reversing roller 1281 moves the first reversing belt 1282, so that the first reversing belt 1282 feeds the recording sheet P while contacting the recording sheet P. Since the first reversing belt 1282 is arranged so as to be opposed to the second reversing belt 1284, the backside of the recording sheet P is contacted with the second reversing belt 1284. When the recording sheet P achieves such a state, the first reversing belt 1282 is stopped and the second reversing belt 1284 is fed by the second reversing roller 1283 in a direction opposite to the moving direction of the first reversing belt 1282. Therefore, the recording sheet P is fed by the second reversing belt 1284 in such a manner that the fixed image is contacted with the second reversing belt 1284. Thus, when the recording sheet P is discharged from the image forming apparatus 1 by the sheet discharger 15, the fixed image faces downward and is contacted with the feeding belt. Thus, the recording sheet P bearing the fixed toner image thereon is discharged by the sheet discharger 15 (step S28).

Meanwhile, the information transmitter 113 transmits the glossiness information, which is received by the information receiver 111, to the image glossing apparatus 2 (step S29).

When the recording sheet P, on which a fixed toner image is formed in the image forming apparatus 1, is fed into the image glossing apparatus 2, the image glossing apparatus 2 heats and presses the toner image to subject the image to a glossing treatment. The glossing treatment will be described by reference to FIG. 13.

The recording sheet P discharged from the image forming apparatus 1 is fed into the entrance of the image glossing apparatus 2, and the recording sheet P is set on the glosser belt 201 in such a manner that the surface of the recording sheet P bearing the fixed toner image thereon is contacted with the glosser belt 201. Thus, the image glossing apparatus 2 receives the recording sheet P (step S31). Next, the recording sheet P is fed by the glosser belt feeder 232 (i.e., the glosser belt 211 which is fed by the rollers 202, 203 and 204) in such a manner that the fixed toner image is contacted with the partial heater 207. In this regard, the position detector 233 (combination of the measuring roller 205 and the sheet detection sensor 206) measures the distance between the tip of the recording sheet P and a portion of the recording sheet P contacted with the partial heater 207 (step S32).

The method for determining the distance between the tip of the recording sheet P and the portion of the recording sheet P contacted with the partial heater 207 in step S32 will be described by reference to FIG. 14. In step S31, the recording sheet P is fed by the glosser belt 201 while contacted therewith. In this case, the measuring roller 205 is rotated by the recording sheet P, which is fed by the glosser belt 201, by friction between the recording sheet P and the measuring roller 205. In this regard, the recording sheet P and the measuring roller 205 have such friction as to prevent slipping of the recording sheet P on the surface of the measuring roller 205.

When the tip detector 234 detects that the tip of the recording sheet P reaches the partial heater 207 (step S321), the rotation angle measuring part 2351 of the moving distance measuring part 235 starts to measure the rotation angle of the measuring roller 205 (step S322).

The method for measuring the rotation angle of the measuring roller 205 will be described by reference to FIGS. 15-17. As illustrated in FIG. 15, the measuring roller 205 has a cylindrical form, and the bottom surface thereof has fan-shaped white and black portions 205*a* and 205*b*, which are arranged alternately and each of which has a center angle of 10 degrees.

A light emitting element 212 and a photosensitive element 213 are arranged in the vicinity of the measuring roller 205. The light emitting element 212 emits light to a predetermined position of the bottom surface of the measuring roller 205, and the photosensitive element 213 receives the light reflected from the bottom surface of the measuring roller 205 while measuring the intensity of the reflected light. Since the measuring roller 205 is rotated by the recording sheet P, which is fed by the glosser belt 211, light emitted from the light emitting element 212 is alternately reflected by the white portion 205*a* and the black portion 205*b*. In this regard, the combination of the measuring roller 205, the light emitting element 212, the photosensitive element 213, and the white and black portions 205*a* and 205*b* serves as the angle measuring device of the image glossing apparatus of the present invention.

FIG. 16 is a schematic view illustrating an example of change of the intensity of light received by the photosensitive element 213. Since the intensity of light is high in a period of time from t1 to t2, a period of time from t3 to t4, a period of time from t5 to t6, and a period of time from t7 to t8, it is clear that the light is reflected from the white portions 205*a* in the periods (i.e., four white portions pass the lighted point). In addition, since the intensity of light is low in a period of time from t0 to t1, a period of time from t2 to t3, a period of time from t4 to t5, and a period of time from t6 to t7, it is clear that the light is reflected from the black portions 205*b* in the periods (i.e., four black portions pass the lighted point). Therefore, it is clear that in a period of time of from t0 (measuring starting time) to t8, the measuring roller 205 rotates at an angle of 80° (10°×8).

After the rotation angle measuring part 2351 measures the rotation angle of the measuring roller 205, the calculator 2352 calculates the distance between the tip of the recording sheet P and a portion of the recording sheet P contacted with the partial heater 207 to determine the position of the portion of the recording sheet contacted with the partial heater 207 (step S323). Specifically, initially the calculator 2352 calculates the moving distance of the measuring roller 205 from the rotation angle of the measuring roller and the circumferential length of the measuring roller. More specifically, since the rotation angle is 80° in this example, the moving distance (L) of the periphery of the measuring roller 205 is CL(80/360), wherein CL represents the circumferential length of the measuring roller 205, and is equal to πD wherein D represents the diameter of the measuring roller 205.

FIG. 17A illustrates the recording sheet P and the measuring roller 205 at a time in which the tip of the recording sheet P reaches the partial heater 207, and a point S of the measuring roller 205 is contacted with the recording sheet P. FIG. 17B illustrates the recording sheet P and the measuring roller 205 at a time in which a time tα passes after the tip of the recording sheet P is detected, and the measuring roller 205 is rotated at an angle of α (i.e., the point S is moved at the angle of α). In this case, the calculator 2352 calculates the moving distance L1 of the recording sheet P from the following formula:

$$L1=\pi D(\alpha/360),$$

wherein D represents the diameter of the measuring roller 205.

FIG. 17C illustrates the recording sheet P and the measuring roller 205 at a time in which a time tβ passes after the tip of the recording sheet P is detected, and the measuring roller 205 is rotated at an angle of β (i.e., the point S is moved at the angle of β). In this case, the calculator 2352 calculates the moving distance L2 of the recording sheet P from the following formula:

$$L2=\pi D(\beta/360).$$

The moving distance L (L1 and L2) of the recording sheet P is the distance between the tip of the recording sheet P and a portion of the recording sheet contacted with the partial heater 207. Namely, the position detector 233 detects that a portion of the recording sheet P apart from the tip thereof by the distance L is contacted with the partial heater 207. When the image on the portion of the recording sheet P is to be glossed, the heating controller 236 controls the partial heater 207 to heat the recording sheet P.

Specifically, at a time in which the portion of the recording sheet P has a Y-coordinate of 1, the heating part 2071 facing a heating unit portion b1 having a glossiness flag 1 among unit portions b having X,Y-coordinates (1,1), (2,1), . . . , and (n,1) heats the heating unit portion b1 while the heating part 2071 facing a non-heating portion b2 having a glossiness flag 0 among unit portions b having X,Y-coordinates (1,1), (2,1), . . . , and (n,1) does not heat the non-heating unit portion b2.

This processing is repeatedly performed when the portion of the recording sheet P has a Y-coordinate of 2, 3, . . . , or n. Thus, the processing is performed at all the Y-coordinates, and therefore the portions of the recording sheet P bearing an image to be glossed are heated by the heating parts 2071 of the partial heater 207 while the other portions of the recording sheet P, which are not to be glossed, are not heated by the heating parts 2071 (step S33). Therefore, only the toner of the toner image to be glossed is heated so as to be melted.

After the recording sheet P is partially heated by the partial heater 207, the second and third pressure rollers 209 and 210 sandwiches the glosser belt 201 and the recording sheet P while applying a pressure thereto (step S34). Therefore, the toner image melted in step S34 is pressed to the smooth surface of the glosser belt 201, thereby smoothing the surface of the toner image. After the second and third pressure rollers 209 and 210 press the recording sheet P in step S34, the cooling part 211 cools the heated toner image (step S35), thereby solidifying the toner image while the toner image maintains the smoothed surface, resulting in formation of a glossy toner image. Thereafter, the recording sheet P bearing a glossed toner image is discharged from the image glossing apparatus 2 (step S36).

By performing the above-mentioned processing, the moving distance of the recording sheet P at any time can be precisely measured by the position detector 233 even when the recording sheet P slips on the glosser belt 201 and is therefore fed at a speed higher or lower than the speed of the glosser belt 201. Therefore, the position of the portion of the recording sheet P contacted with the partial heater 207 at the time can be precisely determined, and the image portion to be glossed can be accurately glossed while the portion not to be glossed is not glossed.

The image glossing apparatus of the present invention is not limited to the above-mentioned image glossing apparatus.

For example, a rotation angle measuring device illustrated in FIG. 18 can be used as the rotation angle measuring part 2351. Specifically, the rotation angle measuring device includes a disc 205*c*, which is rotated together with the measuring roller 205 and has holes 205*d* which are arranged at regular intervals in a peripheral portion near the outer end thereof. In addition, a light emitting element 214 and a photosensitive element 215 are arranged in the vicinity of the measuring roller 205 such that light emitted by the light emitting element 214 can pass through each of the holes 205*d* when the disc 205*c* is rotated. When light emitted by the light emitting element 214 passes through the holes 205*d*, the intensity of light received by the photosensitive element 215 is high. In contrast, when light emitted by the light emitting element 214 strikes the disc 205*c*, the intensity of light received by the photosensitive element 215 is low. By using the change of the intensity of light, the rotation angle of the measuring roller 205 can be measured. In this regard, the combination of the light emitting element 214, the photosensitive element 215, and the disc 205*c* with the holes 205*d* serves as the angle measuring device of the image glossing apparatus of the present invention.

In addition, the glossiness information may be transmitted to the image glossing apparatus 2 from the information processor 3. Alternatively, it is possible for users to input the glossiness information to the image glossing apparatus 2 using the operation panel 107.

In the above-mentioned example, the fan-shaped white and black areas 205*a* and 205*b* of the disc 205 have a center angle of 10°, but the smaller the center angle, the better the preciseness of measurement of the rotation angle of the measuring roller 205, thereby precisely measuring the moving distance of the recording sheet P. Therefore, it becomes possible to gloss a smaller image portion.

In the above-mentioned example, the information receiver 111 receives the RGB image information sent from the information processor 3 via a network. However, the information receiver 111 may receive the RGB image information, which the optical sensor 142 of the scanner 14 obtains from the original set on the glass plate 141.

In the above-mentioned example, the transmitter 321 transmits the image information stored in the image information storage 324 of the information processor 3. However, the transmitter 321 may transmits information such as image information which is generated by the information processor 3 and which is not stored in the image information storage 324.

In addition, it is possible that the under color remover 1122 does not perform the under color removal processing, and the dot area ratios Rc, Rm and Ry obtained by the conversion processing of the image information converter 1121 may be used as the toner dot area ratios according to which the image forming apparatus 1 determines the areas of toner dots.

Further, in the above-mentioned example, the image forming apparatus 1 forms images using cyan, magenta, yellow and black toners. However, the toner is not limited thereto, and other toners such as transparent toner and other color toners can also be used in combination therewith.

In the above-mentioned example, the glossiness information receiver 231 receives the glossiness information sent from the information processor 3. However, the glossiness information receiver 231 may receive the glossiness information input by users using the operation panel 107 of the image forming apparatus 1.

According to the present invention, the distance between the tip of the recording sheet P and the portion of the recording sheet P contacted with the partial heater 207 is measured. Therefore, the position of a portion of the recording sheet P to be glossed can be precisely determined, and it is possible to precisely heat the image portion of the recording sheet to be glossed.

In addition, the moving distance of the recording sheet P is measured by measuring the rotation angle of the measuring roller 205, which is rotated by the fed recording sheet P, and the distance between the tip of the recording sheet P and the portion of the recording sheet P contacted with the partial heater 207 is measured based on the moving distance of the recording sheet P. Therefore, even when the recording sheet P slips on the glosser belt 201 and therefore the moving speed of the recording sheet P is different from that of the glosser belt 201, it is possible to precisely gloss an image portion to be glossed.

Since the recording sheet P is fed in such a manner that the surface of the recording sheet P bearing a toner image is contacted with the upper surface of the glosser belt 201, it can be prevented that the surface of the recording sheet P is released from the glosser belt 201. If the recording sheet P is fed in such a manner that the surface of the recording sheet P bearing a toner image is contacted with the lower surface of the glosser belt 201, the recording sheet P is easily released from the glosser belt 201 by gravitation of the recording sheet P. Therefore it is preferable to feed the recording sheet P in such a manner that the surface of the recording sheet P bearing a toner image is contacted with the upper surface of the glosser belt 201.

Additional modifications and variations of the present invention are possible in light of the above teachings. It is therefore to be understood that within the scope of the appended claims the invention may be practiced other than as specifically described herein.

What is claimed is:

1. An image glossing apparatus to gloss at least part of a fixed toner image on a surface of a recording sheet, comprising:

a recording sheet feeder to feed the recording sheet bearing the fixed toner image in a predetermined direction;

a glossing device including a heater to heat a glossing portion of the fixed toner image on the recording sheet to gloss the glossing portion of the fixed toner image;

a glossiness information obtaining device to obtain glossiness information including position information on position of the glossing portion on the recording sheet; and a position detector including:

a tip detector to detect a tip of the recording sheet fed by the recording sheet feeder; and a distance measuring device to measure a moving distance of the recording sheet fed by the recording sheet feeder after the tip detector detects the tip of the recording sheet, the distance measuring device including a rotor rotated by the recording sheet, which is fed by the recording sheet feeder, and the distance measuring device determines the moving distance of the recording sheet from a moving distance of a periphery of the rotor, wherein the position detector detects position of a portion of the recording sheet facing the heater based on information on the tip of the recording sheet obtained by the tip detector and information on the moving distance of the recording sheet obtained by the distance measuring device, and wherein when the portion of the recording sheet facing the heater is the glossing portion, the heater heats the portion to gloss the portion.

2. The image glossing apparatus according to claim 1, wherein the rotor is rotated by friction between the recording sheet fed by the recording sheet feeder and the periphery of the rotor contacted with the recording sheet.

3. The image glossing apparatus according to claim 1, wherein the distance measuring device includes:

an angle measuring device to measure a rotation angle of the rotor rotated by the recording sheet, and wherein the distance measuring device determines the moving distance of the recording sheet from the rotation angle of the rotor.

4. The image glossing apparatus according to claim 1, wherein the glossing device further includes:

a smoother having a smooth surface to be contacted with the surface of the recording sheet bearing the fixed toner image thereon;

a pressurizer to press the recording sheet, which is heated by the heater, so that the surface of the recording sheet bearing the fixed toner image is contacted with the smooth surface of the smoother; and a cooler to cool the recording sheet after or while the recording sheet is pressed by the pressurizer.

5. An image glossing method for glossing at least part of a fixed toner image on a surface of a recording sheet using a heater, comprising:

feeding the recording sheet bearing the fixed toner image in a predetermined direction;

obtaining glossiness information including position information on position of a glossing portion of the recording sheet to be glossed;

detecting a tip of the fed recording sheet;

rotating a rotor by the fed recording sheet;

measuring a moving distance of the fed recording sheet after detecting the tip of the recording sheet based on a moving distance of a periphery of the rotor;

detecting position of a portion of the recording sheet facing the heater based on information on the tip of the recording sheet and information on the moving distance of the recording sheet; and heating the portion of the recording sheet facing the heater to gloss the portion when the portion is the glossing portion.

6. A non-transitory computer readable medium stores computer instructions, wherein the instructions, when executed by a computer, cause the computer to perform an image glossing method for glossing at least part of a fixed toner image on a surface of a recording sheet using a heater, said image glossing method comprising:

feeding the recording sheet bearing the fixed toner image in a predetermined direction;

obtaining glossiness information including position information on position of a glossing portion of the recording sheet to be glossed;

detecting a tip of the fed recording sheet;

rotating a rotor by the fed recording sheet;

measuring a moving distance of the fed recording sheet after detecting the tip of the recording sheet based on a moving distance of a periphery of the rotor;

detecting position of a portion of the recording sheet facing the heater based on information on the tip of the recording sheet and information on the moving distance of the recording sheet; and heating the portion of the recording sheet facing the heater to gloss the portion when the portion is the glossing portion.

* * * * *